US007241063B2

(12) United States Patent
Sago et al.

(10) Patent No.: US 7,241,063 B2
(45) Date of Patent: Jul. 10, 2007

(54) PRINTER

(75) Inventors: Akira Sago, Seto (JP); Atsushi Kasugai, Nagoya (JP); Nobuhiko Funato, Gifu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 28 days.

(21) Appl. No.: 11/129,360

(22) Filed: May 16, 2005

(65) Prior Publication Data

US 2006/0008312 A1 Jan. 12, 2006

(30) Foreign Application Priority Data

Jul. 12, 2004 (JP) ..... 2004-204815

(51) Int. Cl.
*B41J 11/70* (2006.01)
*B41J 15/04* (2006.01)

(52) U.S. Cl. ..... 400/621; 400/120.16; 400/642; 271/278

(58) Field of Classification Search ..... 101/224, 101/225; 347/197, 198, 220–222; 400/120.16, 400/120.17; 271/278, 285, 286, 65, 306, 271/311, 312; 358/1.12, 1.5; 156/384, 577
See application file for complete search history.

(56) References Cited

U.S. PATENT DOCUMENTS 5,486,259 A * 1/1996 Goodwin et al. ..... 156/384
5,573,236 A * 11/1996 Petocchi et al. ..... 271/265.02
2004/0095593 A1 5/2004 Chung et al.

FOREIGN PATENT DOCUMENTS

JP A 63-242577 10/1988
JP B2 6-13234 2/1994
JP 09-278261 * 10/1997

* cited by examiner

*Primary Examiner*—Daniel J. Colilla
*Assistant Examiner*—W. Ha
(74) *Attorney, Agent, or Firm*—Oliff & Berridge, PLC

(57) ABSTRACT

A top cover and a guide member form a discharge port. A plurality of guide ribs is provided on an edge portion of the top cover. A plurality of projecting pieces is provided on a guide member at positions not to face to the guide ribs. These guide ribs and projecting pieces are used for guiding a roll sheet to a discharge port. At least one of the guide ribs is provided with an extended portion extending upstream in a feeding direction to prevent the roll sheet 3A from curving in a direction vertical to the feeding direction. Thus, the inability to discharge the roll sheet can be avoided.

14 Claims, 13 Drawing Sheets

PRINTER

BACKGROUND OF THE INVENTION

1. Field of the Invention

The present invention relates to a printer capable of smoothly outward discharging a printing medium being transported after printing data requested by a user has been printed thereon and capable of preventing troubles leading to the inability to discharge paper, i.e., jamming, due to curving of the printing medium.

2. Description of Related Art

In a conventional printer, a printing medium tends to be bent because a leading end of the printing medium comes into contact with an outlet portion of a feeding path when the printing medium is transported to the outside. This would cause the inability to discharge paper (jamming). To prevent such jamming, Japanese patent application laid-open publication No. H6(1994)-13234 discloses a technique for smoothly discharging a printing medium by providing a projecting piece in a feeding path along which the printing medium is moved.

A thermal printer disclosed in the '234 publication includes a paper feeding roller mechanism for feeding a printing medium to between a flat platen and a carriage and a paper discharging roller mechanism for catching and discharging the printing medium having passed between the flat platen and the carriage. On the inside of a cover covering a compartment in which the carriage and other components are housed, between the carriage and the discharging roller mechanism, a plurality of projecting pieces are provided extending downward and spaced at given intervals to come into contact with a leading end of the printing medium. These projecting pieces are arranged so that the leading end of the printing medium comes into contact with a center projecting piece first and then other projecting pieces placed on the periphery. The projecting pieces are designed such that one placed at a position corresponding to the center of the printing medium has a longest downward length and others placed as closer to both side edges of the cover have a shorter length.

By bringing the leading end of the printing medium into contact with the center projecting piece first and then the other peripheral projecting pieces as above, it is possible to smoothly guide the leading end of the printing medium from the carriage to the discharge roller mechanism.

SUMMARY OF THE INVENTION

However, the thermal printer disclosed in the '234 publication needs be designed in minute detail about the shape and arrangement of the plurality of projecting pieces with high precision. This printer further needs a space for the projecting pieces, which results in a complicated shape of the cover. This may increase design troubles to design engineers and a production cost.

The present invention has been made in view of the above circumstances and has an object to overcome the above problems and to provide a printer with a simple structure capable of smoothly guiding and discharging a printing medium to and through an outlet of a feeding path while preventing the printing medium from becoming curled or curved in the feeding path to avoid jamming.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the purpose of the invention, there is provided a printer comprising: a printing device which prints print data on a printing medium; a feeding device which feeds the printing medium to the outside; a first feeding path member which forms a feeding path which the printing medium fed by the feeding device passes along; and a second feeding path member which is placed to face to the first feeding path member, forming the feeding path; wherein a plurality of guide pieces for guiding the printing medium to the outside are provided in the first feeding path member at an edge portion thereof and spaced in a direction perpendicular to a feeding direction of the printing medium, and at least one of the guide pieces is formed with an extended portion extending upstream in the feeding direction of the printing medium.

In the above printer, the first feeding path member forming the feeding path of the printing medium is provided with the plurality of guide pieces for guiding the printing medium to the outside arranged in the outlet portion of the feeding path in the direction perpendicular to the feeding direction, so that the printing medium can smoothly be transported. At least one of the guide pieces has the extended portion extending upstream in the feeding direction. Accordingly, the printing medium can surely be prevented from curving in a vertical direction to the feeding direction when the printing medium comes into contact with the extended portion. This makes it possible to prevent a feeding failure of the printing medium.

Further, the above effects can be achieved with a simple structure as compared with a conventional structure as described in the '234 publication, which needs detailed designs for the shape and arrangement of a plurality of projecting pieces. Consequently, there are no troubles to design engineers and no increase in manufacturing cost resulting from a complicated cover shape.

According to another aspect of the invention, there is provided a printer comprising: a printing device which prints print data on a printing medium; a feeding device which feeds the printing medium to the outside; a first feeding path member which forms a feeding path which the printing medium fed by the feeding device passes along; and a second feeding path member which is placed to face to the first feeding path member, forming the feeding path; wherein a plurality of guide pieces for guiding the printing medium to the outside are provided in the first feeding path member at an edge portion thereof and spaced in a direction perpendicular to a feeding direction of the printing medium, at least one of the guide pieces is formed with an extended portion extending upstream in the feeding direction of the printing medium, and the second feeding path member is provided with a plurality of projecting pieces for guiding the printing medium to the outside, the projecting pieces being arranged near an outlet of the feeding path and spaced in the direction perpendicular to the feeding direction.

In the above printer, the first feeding path member forming the feeding path of the printing medium is provided with the plurality of guide pieces for guiding the printing medium to the outside arranged in the outlet portion of the feeding path in the direction perpendicular to the feeding direction, so that the printing medium can smoothly be transported. At least one of the guide pieces has the extended portion extending upstream in the feeding direction. Accordingly, the printing medium can surely be prevented from curving in a vertical direction to the feeding direction when the printing medium comes into contact with the extended portion. This makes it possible to prevent a feeding failure of the printing medium.

The second feeding path member is provided with the plurality of projecting pieces for guiding the printing medium to the outside, the projecting pieces being arranged near the outlet of the feeding path and spaced in the direction perpendicular to the feeding direction so that the projecting pieces do not face to the guide pieces. Accordingly, the outlet of the feeding path is not partially narrowed, which makes it possible to avoid jamming of the printing medium in such narrowed path. The printing medium is guided through the guide pieces and the projecting pieces to the outlet of the feeding path, so that the printing medium can smoothly be fed.

According to another aspect of the invention, there is provided a printer comprising: a printing device which prints print data on a selected one of printing media of different widths; a feeding device which feeds the printing medium to the outside, the selected printing medium being mounted relative to one side in a width direction, common to the printing media of any width; a cutting device which cuts the printing medium in the width direction; a first feeding path member which forms a feeding path which the printing medium fed by the feeding device passes along; and a second feeding path member which is placed to face to the first feeding path member, forming the feeding path; wherein a plurality of guide pieces for guiding the printing medium to the outside are provided in the first feeding path member at an edge portion thereof and spaced in a direction perpendicular to a feeding direction of the printing medium, each guide piece being slightly spaced from a side edge of the printing medium at a cutting start position by the cutting device, the guide piece formed at one place in the feeding path along which the printing medium of any width is fed is provided with an extended portion extending upstream in the feeding direction of the printing medium, the second feeding path member is provided with a plurality of projecting pieces for guiding the printing medium to the outside, the projecting pieces being arranged near an outlet of the feeding path and spaced in the direction perpendicular to the feeding direction, at positions misaligned with the guide pieces, and the outlet of the feeding path restricts a vertical movement of the printing medium with respect to the feeding direction during cutting of the printing medium.

In the above printer, the first feeding path member is provided with the plurality of guide pieces for guiding the printing medium to the outside. The guide pieces are arranged near the outlet of the feeding path and spaced in the direction perpendicular to the feeding direction. Thus, the printing medium can smoothly be fed.

Furthermore, at least one of the guide pieces has the extended portion extending upstream in the feeding direction. When the printing medium comes into contact with the extending portion, the printing medium can be prevented from curving in a vertical direction with respect to the feeding direction. This makes it possible to prevent a feeding failure of the printing medium.

The printer allows the use of a plurality of printing media of different widths. The printing medium of any width is mountable relative to one side in the width direction, common to the printing media. The guide piece having the extended portion is formed at one place within the feeding path along which any printing medium is fed, so that the printing medium of any width mountable in the printer is sure to come into contact with the extended portion. Accordingly, the unwound part of the printing medium can surely be prevented from curving in the vertical direction with respect to the feeding direction, which avoids a feeding failure of the printing medium.

Herein, the curving includes two types. One occurs due to friction in the feeding path in which all the guide pieces have no extended portion. This curving (a first curving) can be prevented by the guide piece having the extended portion according to the present invention. The other occurs due to friction increased in the feeding path narrowed by the guide piece(s) having the extended portion(s). As the number of guide pieces having the extended portion(s) is too larger, the curving of this type (a second curving) often occurs. However, the present invention includes only one guide piece having the extended portion, in which the curving will not occur due to such cause.

Since only one guide piece is designed to have the extended portion, design troubles to design engineers and an increase in manufacturing cost can be avoided as compared with the case where all the guide pieces have no extended portion.

In the second feeding path member, the plurality of projecting pieces for guiding the printing medium to the outside are arranged near the outlet of the feeding path and at positions not to face to the guide pieces. This makes it possible to prevent the outlet of the feeding path from partially narrowing and hence prevent the occurrence of jamming of the printing medium. Thus, the printing medium can smoothly be guided to the outlet of the feeding path and discharged through the outlet.

The printer includes the cutting device for cutting the printing medium in the width direction, and the guide piece formed at the outlet of the feeding path is slightly spaced from the side end of the printing medium at the cutting start position by the cutting device. This makes it possible to restrict the vertical movement of the printing medium with respect to the feeding direction during the cutting, in particular, to restrict the movement of the side edge of the printing medium at the cutting start position. It is therefore possible to hold the printing medium against the vertical movement with respect to a printing surface during the cutting. Further, it is possible to prevent the end portion of the printing medium at the cutting start position from curling. This makes it possible to avoid a cutting failure by the cutting device and to cut the printing medium finely.

BRIEF DESCRIPTION OF THE DRAWINGS

The accompanying drawings, which are incorporated in and constitute a part of this specification illustrate an embodiment of the invention and, together with the description, serve to explain the objects, advantages and principles of the invention.

In the drawings.

DETAILED DESCRIPTION OF THE PREFERRED EMBODIMENTS

A detailed description of a preferred embodiment of a label printer for a printer embodying the present invention will now be given referring to the accompanying drawings.

Firstly, a schematic structure of the label printer in the present embodiment will be described with reference to FIGS. 1 to 7.

Figure 1:
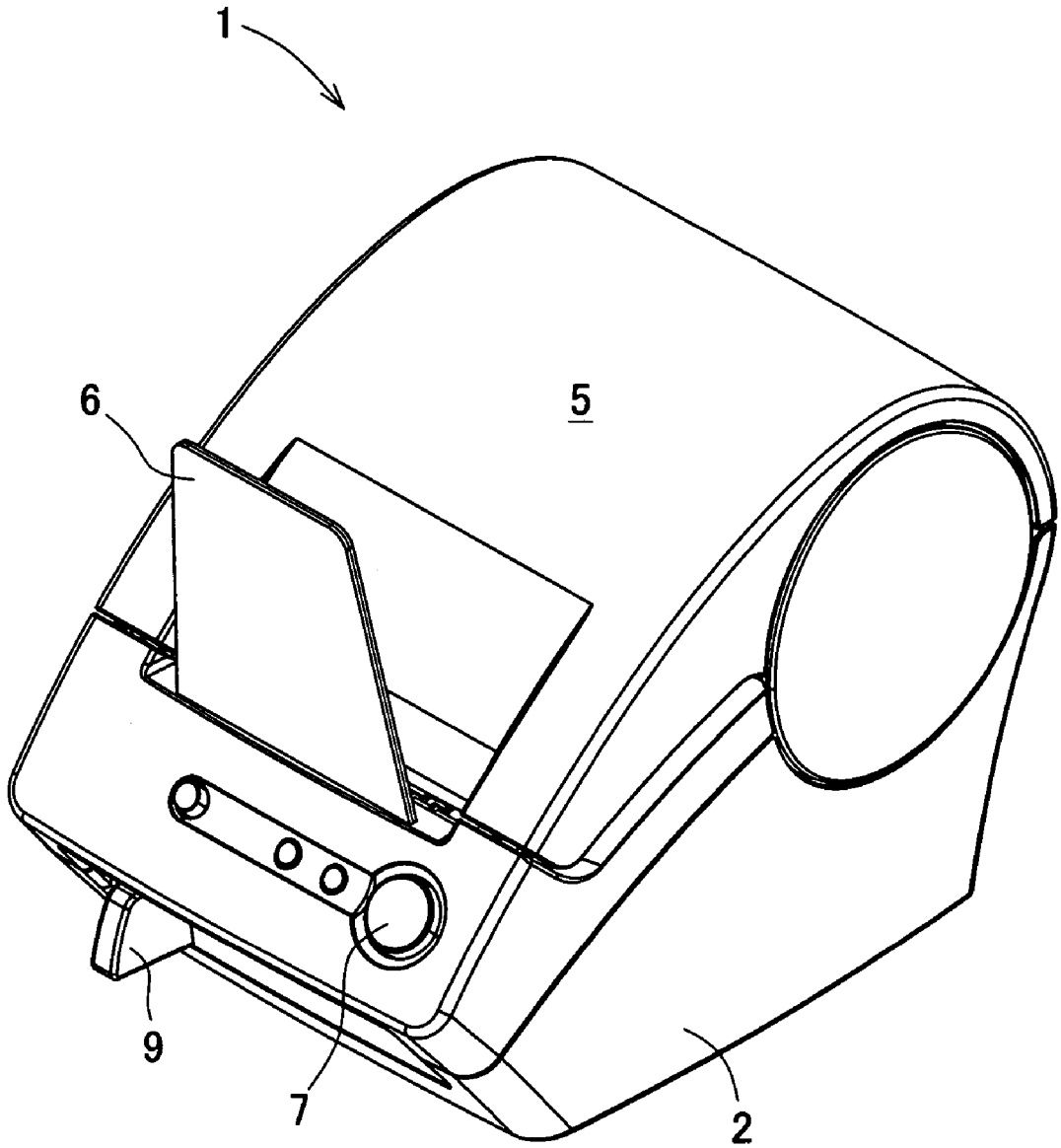
FIG. 1 is a perspective view of a label printer in a present embodiment.
Figure 2:
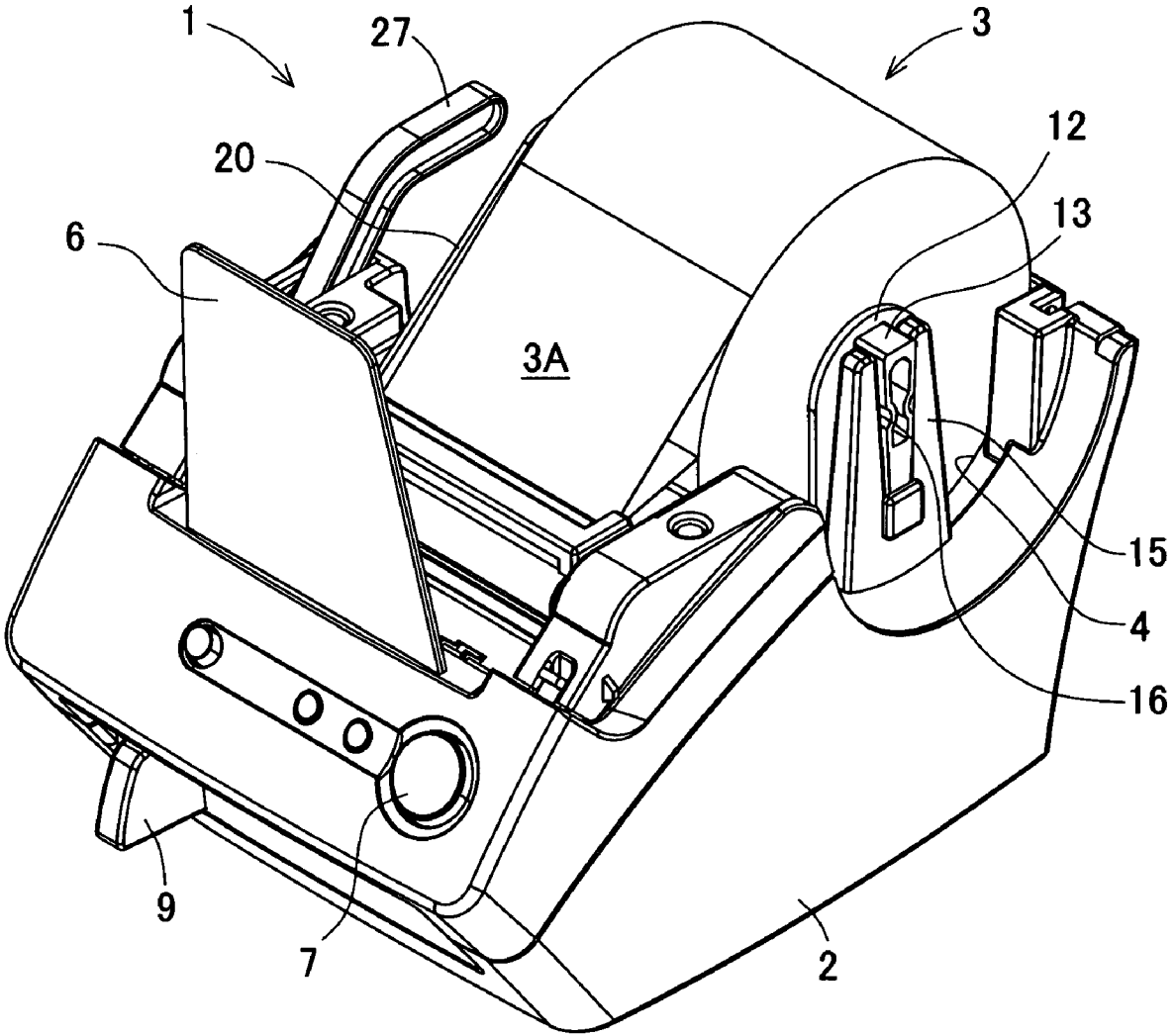
FIG. 2 is a perspective view of the label printer of which a top cover is removed, in which a roll sheet holder is mounted.
Figure 3:
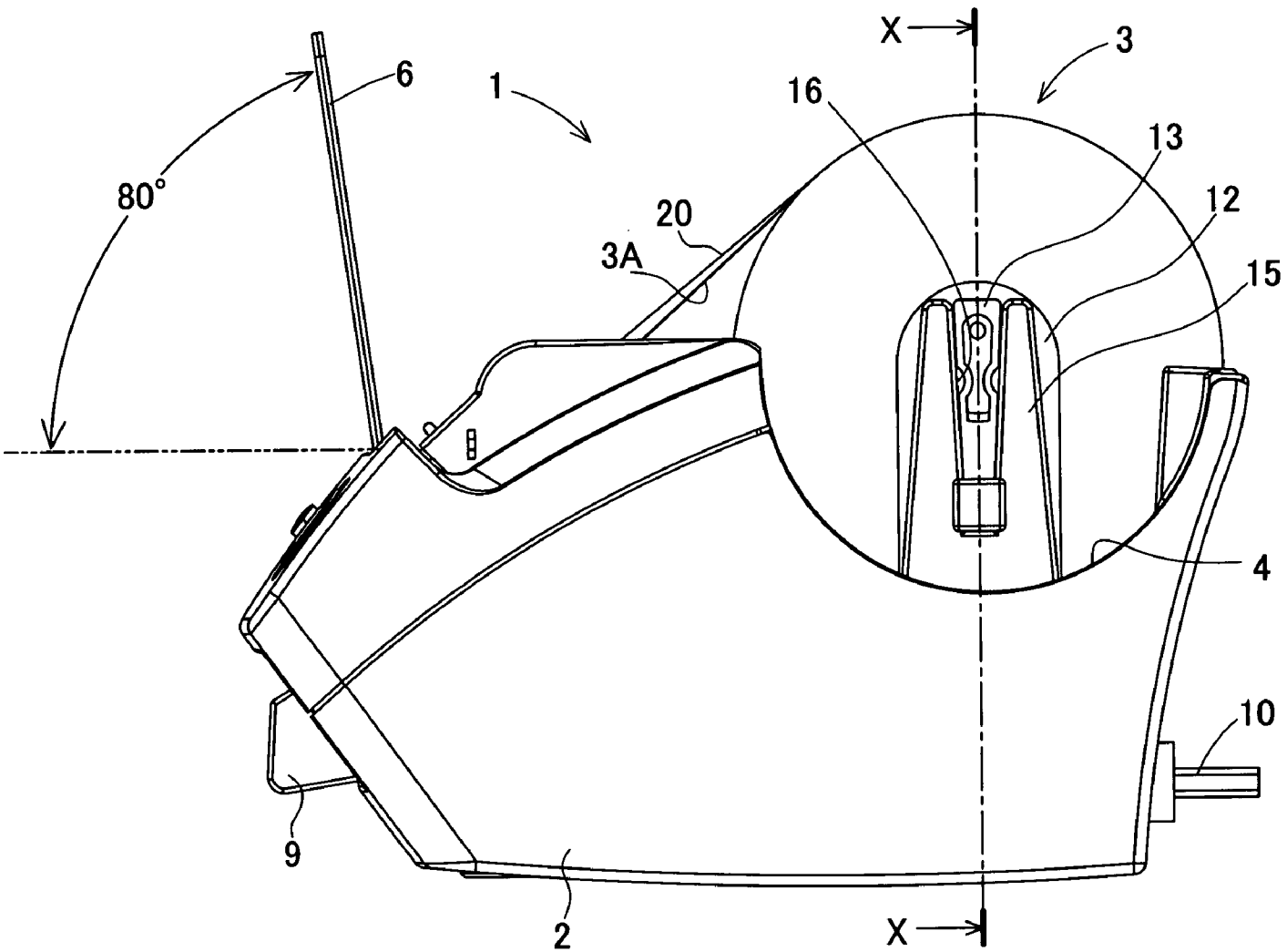
FIG. 3 is a side view of the label printer of FIG. 2.

As shown in FIGS. 1 to 3, a label printer 1 includes a housing (main body) 2, a top cover 5 (a first feeding path member) made of transparent resin attached to the housing 2 at a rear upper edge, a tray 6 made of transparent resin disposed in a standing position to face to a substantially front center of the top cover 5, a power button 7 placed in front of the tray 6, a cutter lever 9 movable side to side to horizontally move a cutter unit 8 (see FIG. 7), and others. The top cover 5 is freely opened and closed, thereby covering an upper part of a roll sheet holder storage part (hereinafter, a "holder storage part") 4 which is a space for receiving a roll sheet holder 3 holding a roll sheet 3A of a predetermined width to be used as a printing medium. This top cover 5 will be further mentioned in detailed later.

In the present embodiment, each sheet discrimination sensor S1 to S5 (see FIG. 4) is placed so that a plunger thereof always protrudes from the bottom of a discrimination recess 4B, maintaining a microswitch in an OFF state. In the case where a sheet discrimination part 60 has some sensor hole(s) 60A at the positions corresponding to the sheet discrimination sensors S1 to S5, the plunger(s) of the sensor(s) for which the sheet discrimination part 60 has sensor hole(s) is allowed to pass through the associated sensor hole(s) 60A without depression, leaving the corresponding microswitch(es) in the OFF state. At this time, each microswitch in the OFF state generates an OFF signal. On the other hand, the plunger(s) of the sensor(s) for which the sheet discrimination part 60 has no sensor hole(s) is depressed, bringing the corresponding microswitch(es) into the ON state. Each microswitch in the ON state generates an ON signal. In this manner, the kind of the roll sheet 3A can be determined based on combinations of the ON signals and the OFF signals of the sensors S1 to S5.

Figure 10B:
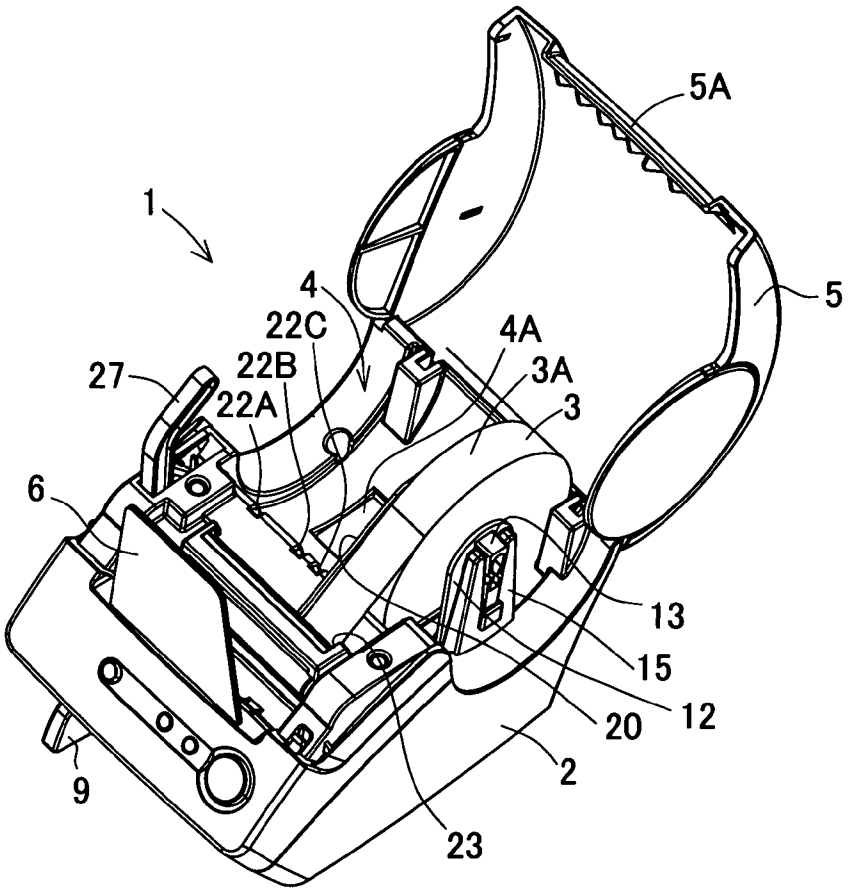
FIG. 10B is a perspective view of the label printer in the present embodiment, in which the roll sheet holder holding a roll sheet of a minimum width W1 is mounted.
Figure 10A:
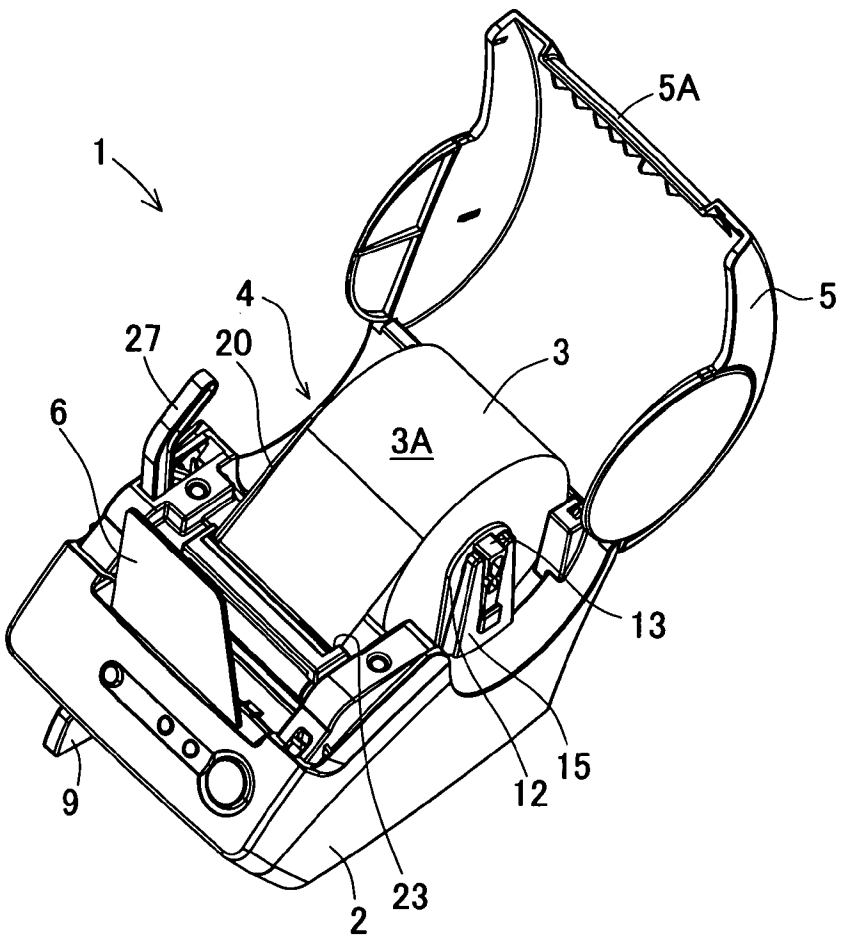
FIG. 10A is a perspective view of the label printer in the present embodiment, in which the roll sheet holder holding a roll sheet of a maximum width W4 is mounted.

In an insertion port 18 at its one side end (a left end in FIG. 6) on a holder support member 15 side, a guide rib 23 is formed so that its surface is substantially flush with an inside surface of a sheet holding member 12 when engaged in the holder support member 15. This guide rib 23 serves to restrict displacement of the roll sheet 3A in a width direction during feeding. A side edge of an unwound part of the roll sheet 3A comes into contact with the surface of the guide rib 23. As shown in FIGS. 10A and 10B. the side edge of the roll sheet 3A of any width; a minimum width W1 to a maximum width W4, will be in contact with the guide rib 23. The unwound part of the roll sheet 3A can be fed without displacement regardless of the width of the roll sheet 3A in use.

A lever 27 for vertically moving a thermal head 31 (see FIG. 7) is provided in front of the other side end (a left end in FIG. 5) of the holder storage part 4. To be more specific, when the lever 27 is turned up, the thermal head 31 is moved down and separated from a platen roller 26 (see FIG. 7). When the lever 27 is turned down, to the contrary, the thermal head 31 is moved up, thereby pressing the unwound part of the roll sheet 3A against the platen roller 26. A printable condition is thus developed. Herein, the platen roller 26 used for thermal printing presses the roll sheet 3A against the thermal head 31, while the platen roller 26 used as a feeding device is rotated to feed a printed part of the roll sheet 3A to the outside.

Further, under the holder storage part 4, a control circuit (not shown) is provided for driving and controlling each mechanism in response to commands from an external personal computer and others.

The following explanation is made on a step of mounting the roll sheet holder 3 to a step of obtaining a print result desired by a user. The roll sheet holder 3 is set in such a way that a mounting piece 13 of the sheet holding member 12 is inserted from above into a first positioning groove 16 of the holder support member 15 and a front lower end of a guide member 20 is engaged in appropriate one of second positioning grooves 22A to 22D. In this state, a lower end portion of the guide member 20 is fittingly inserted in a positioning recess 4A. Thus the roll sheet holder 3 is removably mounted in the holder storage part 4.

The lever 27 is turned up and an unwound part of the roll sheet 3A is pulled out while keeping one side edge of the unwound part of the roll sheet 3A in contact with the inside surface of the guide member 20. Then, a leading end of the unwound part of the roll sheet 3A is inserted into the insertion port 18 while the other side edge of the unwound part is held in contact with the guide rib 23 provided at the side end of the insertion port 18. Accordingly, the roll sheet 3A can be mounted in position at any time without laterally displacement in the label printer 1.

After the leading end of the roll sheet 3A is inserted into the insertion port 18, the lever 27 is turned down. The thermal head 31 is accordingly moved upward to press the roll sheet 3A against the platen roller 26. The label printer 1 is thus placed in a printing enabled state.

Upon receiving a printing command signal from an external device not shown, the label printer 1 drives a stepping motor or the like not shown to rotate the platen roller 26 and drives and controls the thermal head 31. In this state, image data can be printed on a printing surface of the roll sheet 3A which is fed sequentially. This printing is performed on a surface of the roll sheet 3A being transported and pressed against the thermal head 31. At this time, the printing surface of the roll sheet 3A faces downward.

The printed part of the roll sheet 3A with the printing surface facing downward passes a cutter plate 8A and a discharge port (outlet) 19 in order and onto a tray 6.

The cutter plate 8A is provided with the cutter unit 8 which is moved reciprocally in the width direction of the roll sheet 3A to cut out the printed part of the roll sheet 3A. A guide member 24 (a second feeding path member) is placed on the cutter plate 8A at a position downstream in the feeding direction of the roll sheet 3A from the cutter unit 8. This guide member 24 forms the discharge port 19 in combination with the edge of the top cover 5. The guide member 24 is formed with a plurality of projecting pieces 25 (see FIG. 12) spaced in the width direction of the roll sheet 3A. Each projecting piece 25 is formed to have an upper surface connecting between an upper surface of the cutter plate 8 and a lower edge of the discharge port 19. Accordingly, the roll sheet 3A coming into contact with the upper surfaces of the projecting pieces 25 can be smoothly guided to the discharge port 19 and finally discharged onto the tray 6. The roll sheet 3A discharged on the tray 6 is cut with the cutter unit 8 when the cutter lever 9 is operated to move rightward in FIG. 1.

A schematic structure of the roll sheet holder 3 will be described below, referring to FIGS. 4, 8, and 9.

Figure 4:
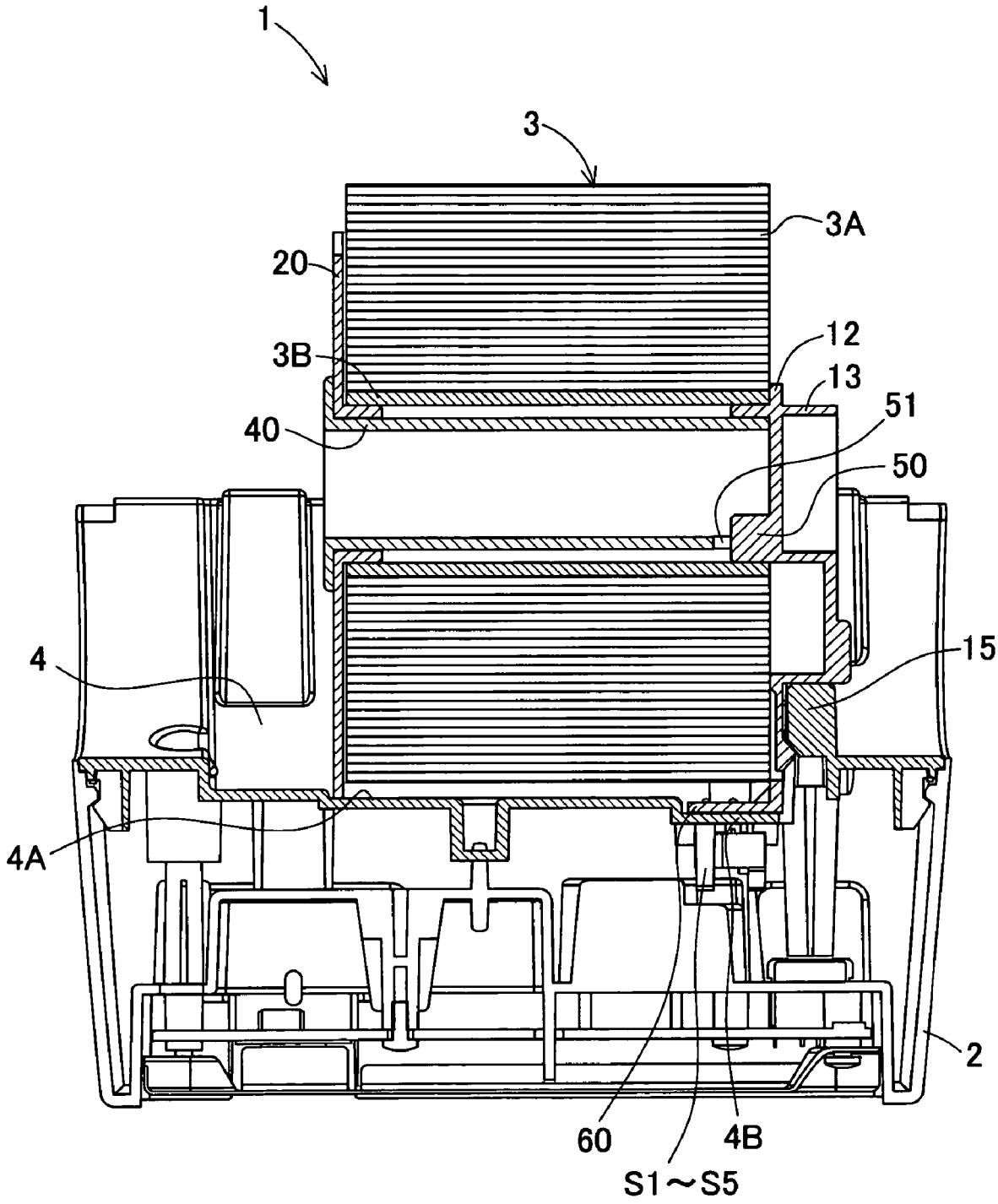
FIG. 4 is a sectional view of the label printer taken along a line X-X in FIG. 3.
Figure 5:
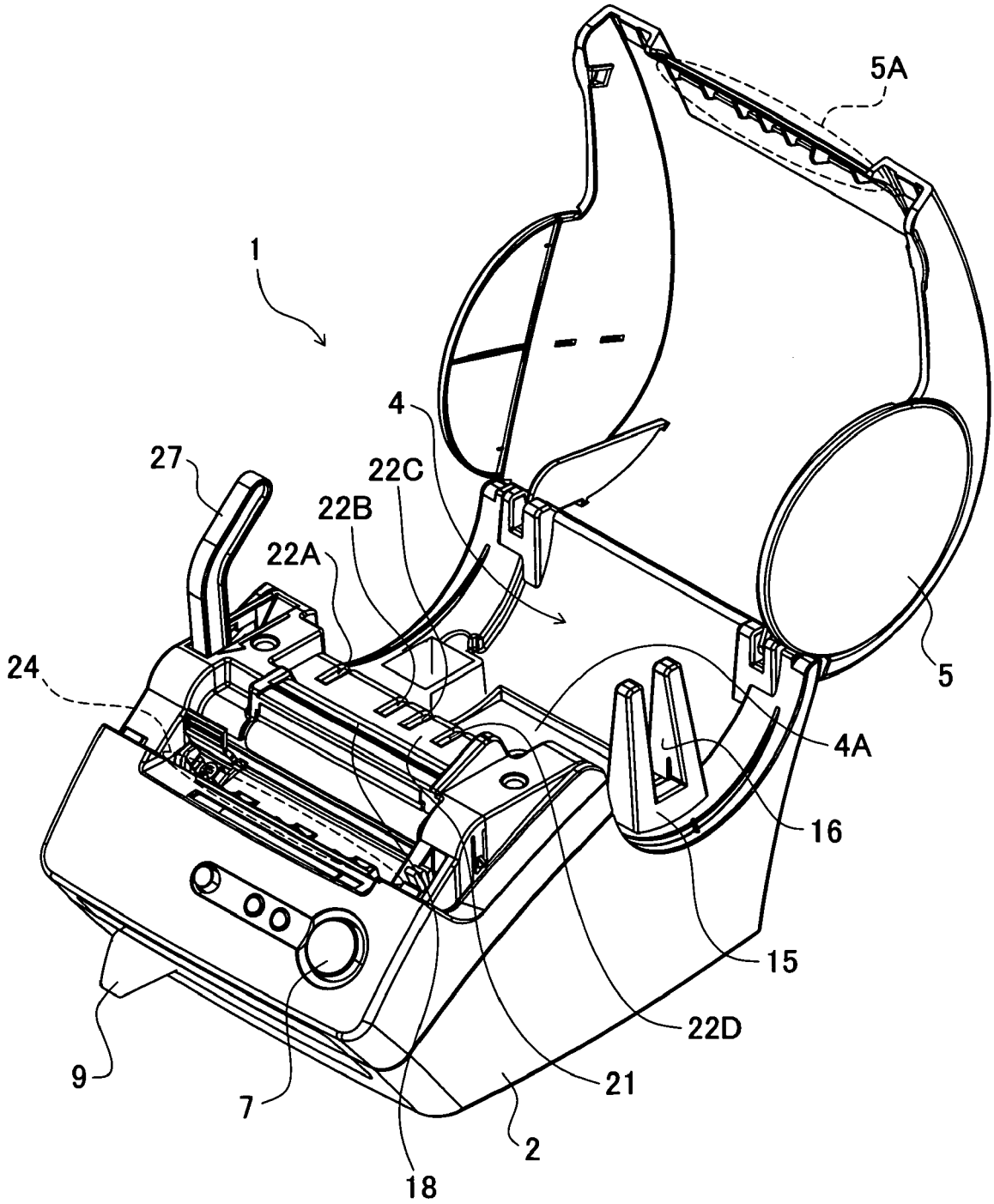
FIG. 5 is a perspective view of the label printer in the present embodiment with the top cover being opened.
Figure 6:
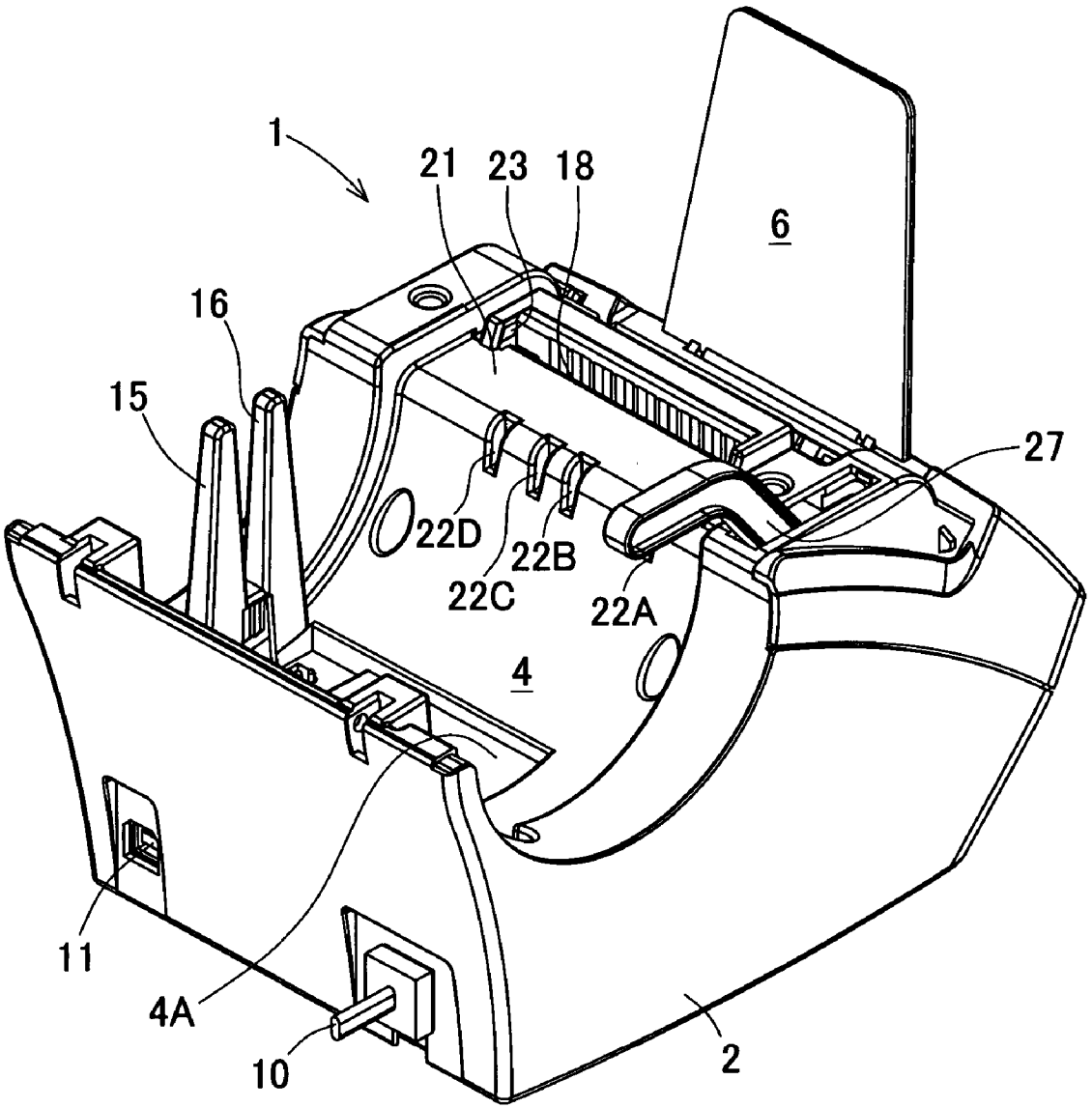
FIG. 6 is a perspective back view of the label printer of which the top cover is removed.
Figure 7:
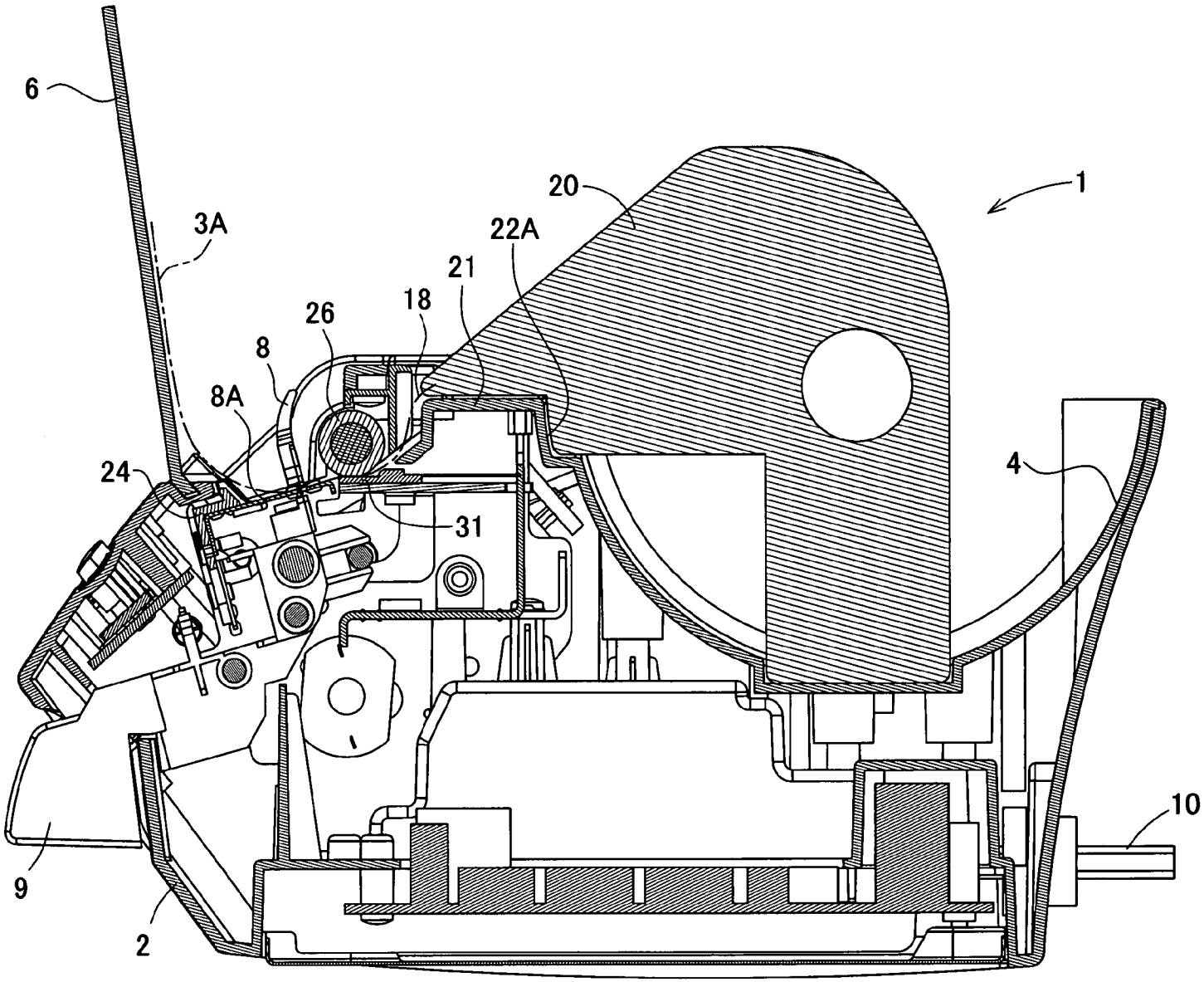
FIG. 7 is a sectional side view of main parts of the label printer in the present embodiment.
Figure 8A:
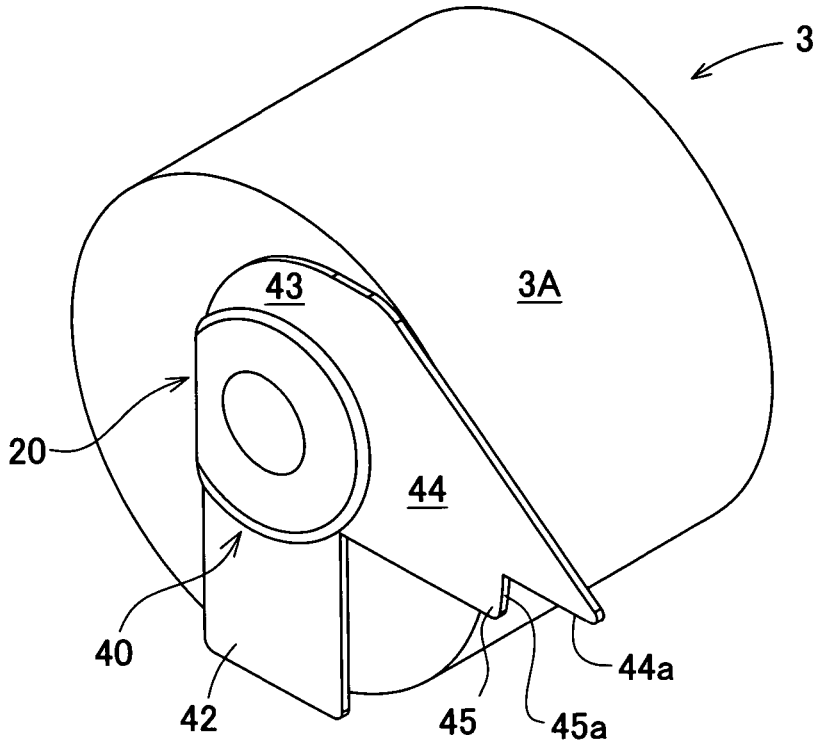
FIG. 8A is a perspective view of a roll sheet and a roll sheet holder to be mounted in the label printer.
Figure 8B:
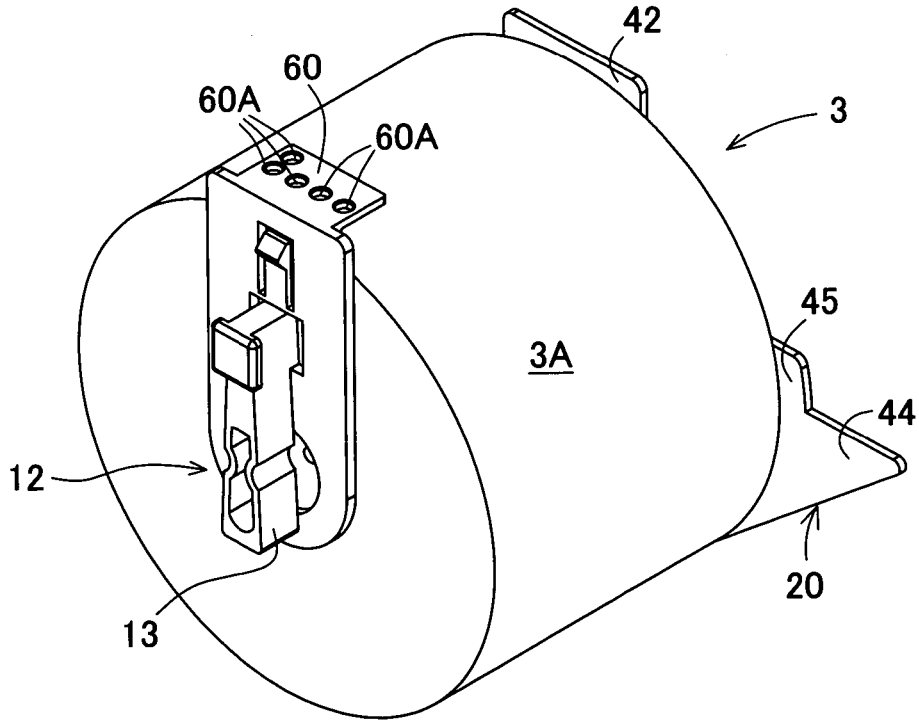
FIG. 8B is a perspective view of the roll sheet holder holding the roll sheet, turned upside down from a state shown in FIG. 8A.
Figure 9B:
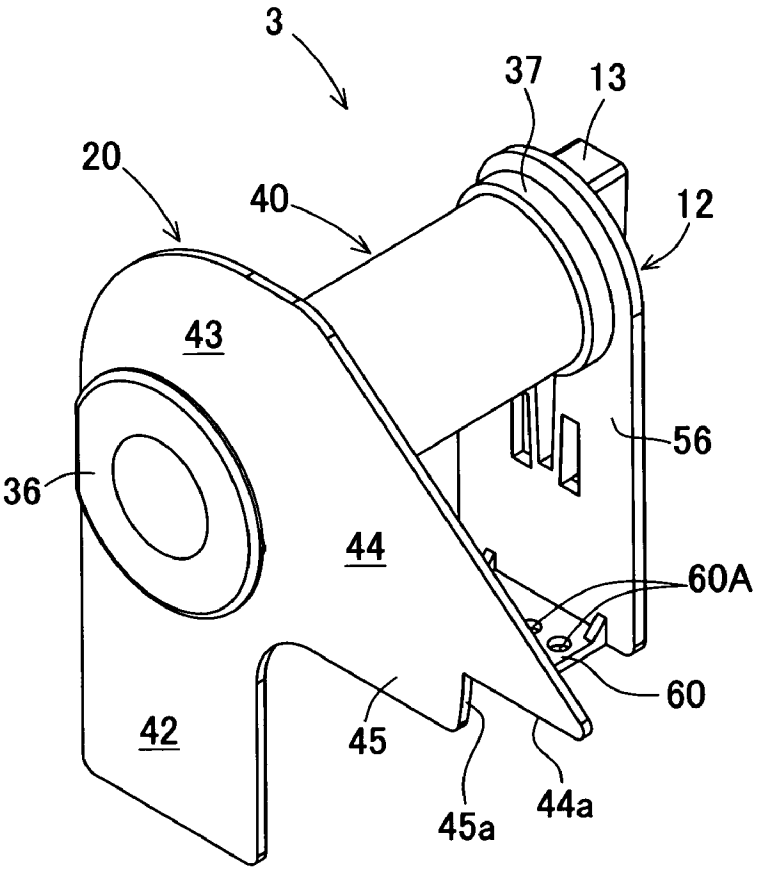
FIG. 9B is a perspective view of the roll sheet holder seen from an obliquely front direction.
Figure 9A:
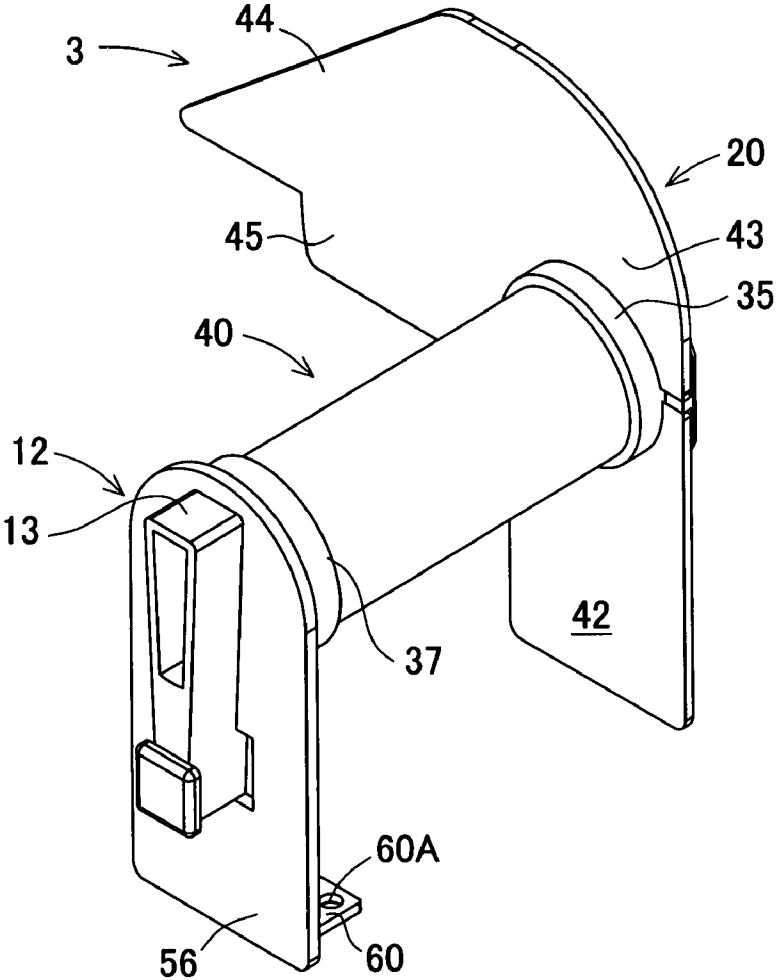
FIG. 9A is a perspective view of the roll sheet holder seen from an obliquely back direction.

As shown in FIGS. 4, 8, and 9, the roll sheet holder 3 is basically constructed of the roll sheet 3A wound around a cylindrical sheet core 3B, a holder shaft 40, the guide member 20, and the sheet holding member 12. Specifically, the holder shaft 40 mounts thereon the sheet core 3B and the guide member 20 to rotatably hold the roll sheet 3A. The holder shaft 40 is also provided with a flange 36 for restricting movements of the guide member 20 in the width direction. The guide member 20 has a first cylindrical part 35 in which one open end of the holder shaft 40 is fitted. The sheet holding member 12 includes a second cylindrical part 37 in which the other open end of the holder shaft 40 is fitted and which is equal in diameter to the first cylindrical part 35.

The sheet core 3B around which the roll sheet 3A is wound is a cylindrical member formed with a slightly larger diameter than the outer diameters of the first cylindrical part 35 of the guide member 20 and the second cylindrical part 37 of the sheet holding member 12. The first and second cylindrical parts 35 and 37 are inserted in both open ends of the sheet core 3B respectively to rotatably hold the sheet core 3B and the roll sheet 3A (see FIG. 4).

The holder shaft 40 is a cylindrical member formed with a smaller diameter than the inner diameters of the first and second cylindrical parts 35 and 37. The holder shaft 40 is formed with the flange 36 at an end on the guide member 20 side and with a slit 51 at an end on the sheet holding member 12 side (see FIG. 4).

The guide member 20 is provided with a first extended portion 42 extending downward from a lower periphery of an outer end face of the first cylindrical part 35. This first extended portion 42 is fitted in the positioning recess 4A formed in the bottom of the holder storage part 4 so that the lower end surface of the first extended portion 42 is in contact with the bottom surface of the positioning recess 4A.

The guide member 20 is further provided with a second extended portion 43 extending upward to cover a front quarter round of the end face of the roll sheet 3A. A third extended portion 44 is formed continuously extending from the second extended portion 43 up to near the insertion port 18 (see FIG. 6) and has an upper edge sloped downward to the front end. This third extended portion 44 further has a lower edge (44*a*) extending horizontally, which is held in contact with a flat portion 21 of the label printer 1 so that one side edge of the unwound part of the roll sheet 3A is guided along the inside surfaces of the second and third extended portions 43 and 44 up to the insertion port 18.

A fourth extended portion 45 is further formed under the third extended portion 44 between the rear end of the lower edge 44*a* at a predetermined distance from the front end and the first extended portion 42. When the lower edge 44*a* of the third extended portion 44 is held in contact with the flat portion 21, a front edge (45*a*) of the fourth extended portion 45 is inserted in appropriate one of the second placing grooves 22A to 22D corresponding to the sheet width of the roll sheet 3A set in the sheet holder 3 (see FIG. 6).

A positioning rib 50 is formed protruding inward from an inner lower end of the second cylindrical part 37 in which the end of the holder shaft 40 is fitted. This rib 50 is engaged in the slit 51 of the holder shaft 40. The sheet holding member 12 and the guide member 20 can correctly be positioned with respect to each other through the holder shaft 40. Accordingly, the size of the roll sheet holder 3 in the width direction is determined.

The first and second cylindrical parts 35 and 37 serve to rotatably support the sheet core 3B of the roll sheet 3A. The holder shaft 40 may be selected from among a plurality of shafts of different lengths (four lengths; W1, W2, W3, and W4 in the present embodiment) individually corresponding to the lengths of the sheet cores 3B (i.e., the widths of the roll sheets 3A).

The outer open end of the second cylindrical part 37 is closed by the sheet holding member 12. An extended portion 56 is continuously formed extending downward from the second cylindrical part 37. An inner surface of the extended portion 56 is held in contact with the end face of the roll sheet 3A and the sheet core 3B.

On the outer surface of the extended portion 56, the longitudinal mounting piece 13 is provided protruding outward, at substantially the center of the sheet holding member 12 in the width direction as shown in FIG. 9B. This mounting piece 13 has a substantially rectangular section and a width which becomes smaller in a downward direction so that the mounting piece 13 is fitted in the first positioning groove 16. The protruding distance of the mounting piece 13 is determined to be almost equal to the width of the first positioning groove 16, i.e., the thickness of the holder support member 15.

The sheet holding member 12 is designed to have the extended portion 56 extending downward longer by a predetermined length (about 1.0 mm to 2.5 mm in the present embodiment) than the lower end (the first extended portion 42) of the guide member 20. The sheet holding member 12 is also provided, at the lower end of the extended portion 56, with a sheet discrimination part 60 of a substantially rectangular shape extending inward by a predetermined length at almost right angle to the extended portion 56.

This sheet discrimination part 60 is formed with sensor holes 60A at predetermined positions facing the sheet discrimination sensors S1 to S5. The sensor holes 60A represent the width of the roll sheet 3A (four widths W1 to W4).

Figure 11:
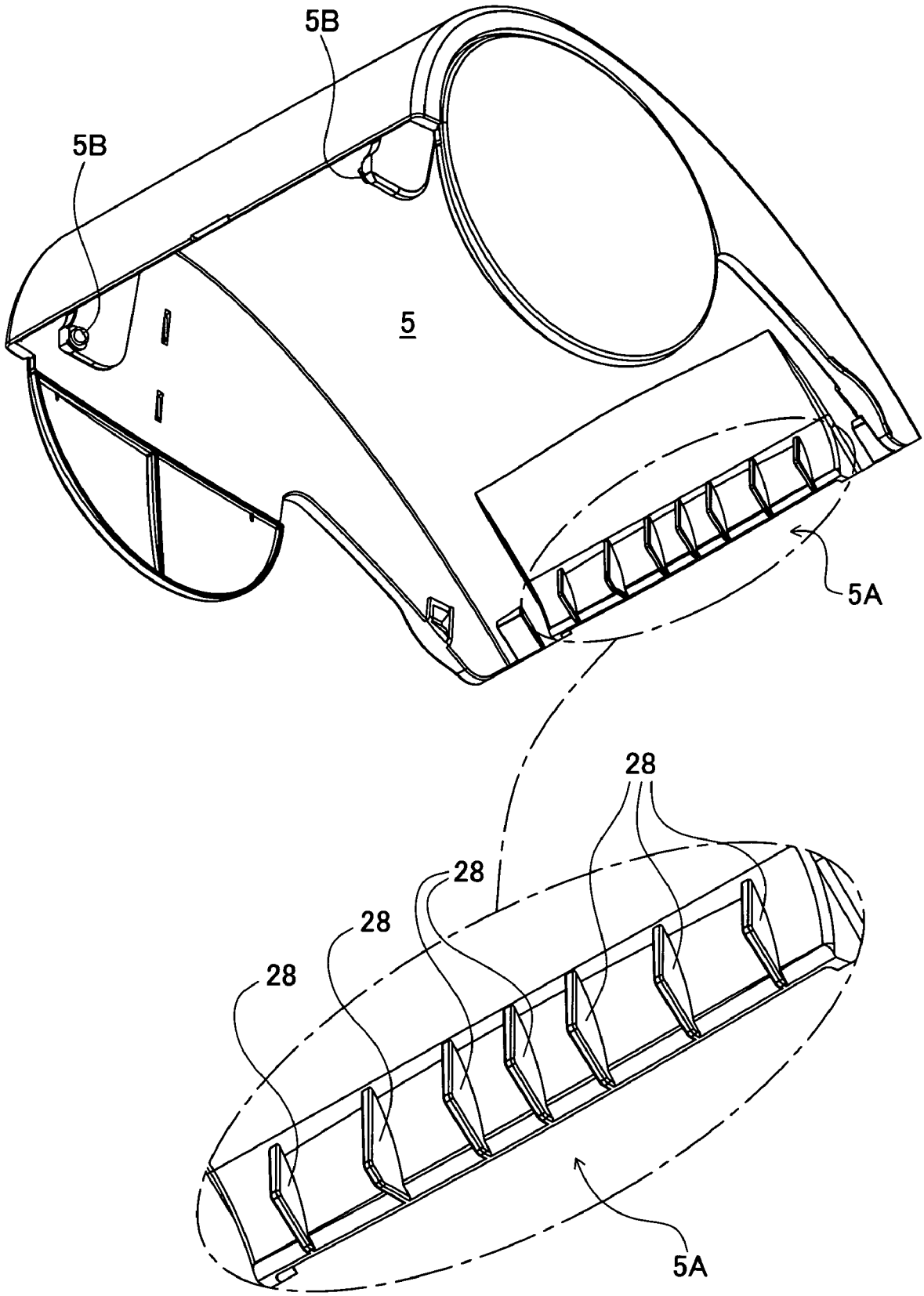
FIG. 11 is a perspective view of the top cover of the label printer and an enlarged view of an upper edge portion of a discharge port.

The top cover 5 will be explained in detail below with reference to the accompanying drawings. FIG. 11 is an external perspective view of the top cover 5 seen from inside. As mentioned above, the top cover 5 having pivot shafts 5B (see FIG. 11) is attached to the rear upper edge of the housing 2 through the pivot shafts 5B. The cover 5 can be rotated about the pivot shafts 5B to be freely opened and closed (see FIG. 10A). The top cover 5 is a transparent resinous member for covering the upper part of the holder storage part 4.

At an opposite side (a lower side in FIG. 11) to the pivot shaft, the top cover 5 is provided with an edge portion 5A having a slightly wider width than the maximum width of the roll sheet 3A mountable in the label printer 1. The edge portion 5A will form an upper edge of the discharge port 19 when the top cover 5 is closed.

On an inner surface of the top cover 5 at the edge portion 5A, a plurality of guide ribs 28 (seven ribs in the present embodiment) are provided protruding in parallel with the feeding direction of the roll sheet 3A and spaced in a direction perpendicular to the feeding direction, namely, in the width direction of the roll sheet 3A.

Figure 12:
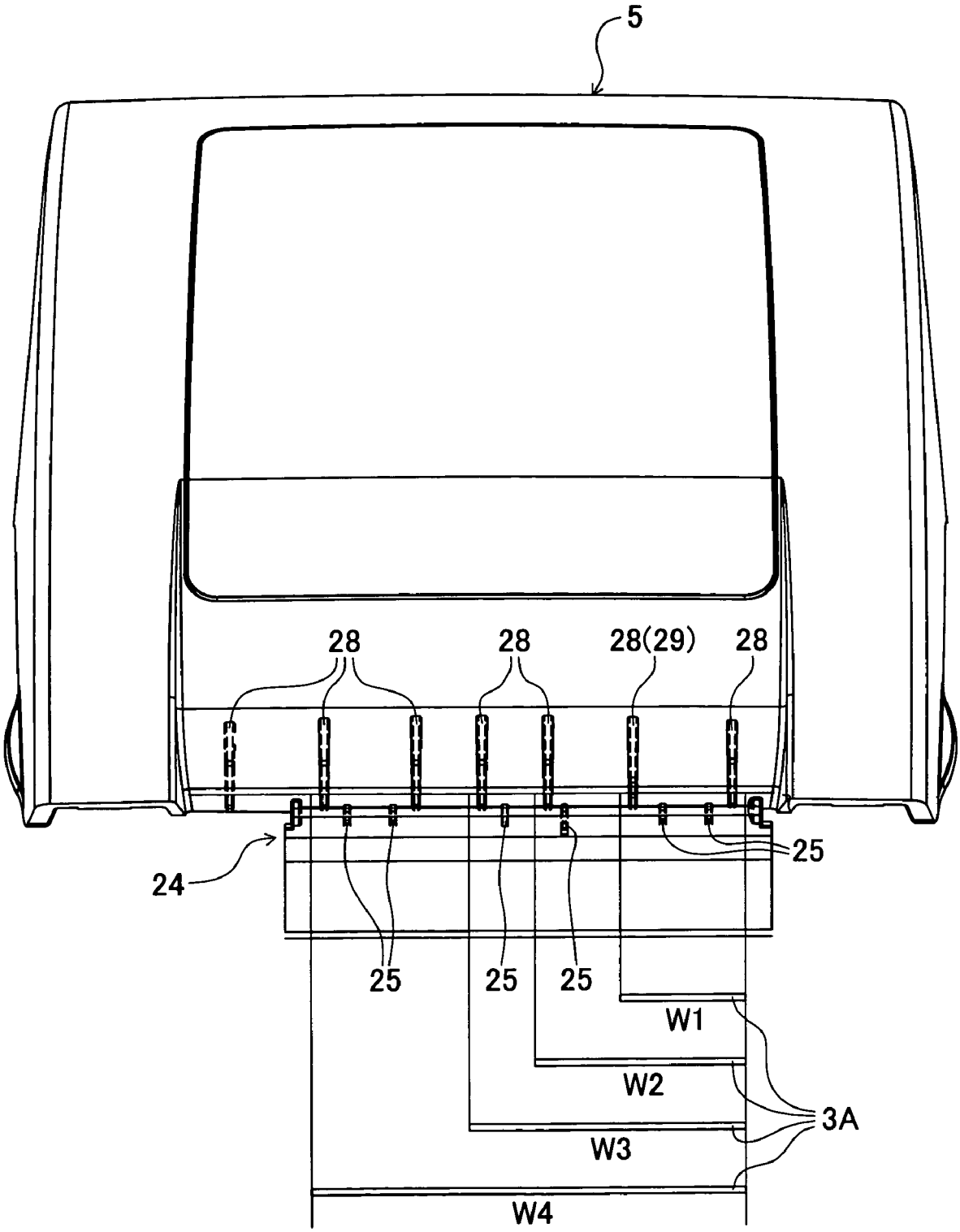
FIG. 12 is an explanatory view showing a positional relationship between guide ribs and projecting pieces with respect to the roll sheet widths W1 to W4.

The positions of the guide ribs 28 in the edge portion 5A will be explained in detail below with reference to the accompanying drawings. FIG. 12 is an explanatory view showing a positional relationship along the roll sheet 3A and the guide ribs 28 and the projecting pieces 25.

As shown in FIGS. 10A and 10B, in the label printer 1 in the present embodiment, any available roll sheet 3A is mounted so that its side edge is in contact with the holder support member 15. Since the roll sheet 3A is mounted in such a positional relation, the guide ribs 28 are formed at corresponding positions to the widths (W1 to W4) of the roll sheets 3A available for the label printer 1.

Referring to FIG. 12, the guide rib 28 formed on the holder support member 15 side serving as a mounting reference position of the roll sheet 3A of any width W1 to W4 is at a position slightly inwardly from the side edge of the roll sheet 3A which comes into contact with the surface of the guide rib 28 (at a distance of 2 mm to 4 mm from the side edge of the roll sheet 3A in the present embodiment).

Other guide ribs 28, on the other hand, are formed at positions slightly inward from the other side edge of the roll sheet 3A on the guide member 20 side (at a distance of 2 mm from this side edge of the roll sheet 3A in the present embodiment), each corresponding to each width of the roll sheets 3A.

As above, even when the roll sheet 3A of any width W1 to W4 is mounted in the label printer 1, the side edges of the roll sheet 3A in the width direction are guided along the associated guide ribs 28 and thus the roll sheet 3A can be discharged smoothly.

Figure 13A:
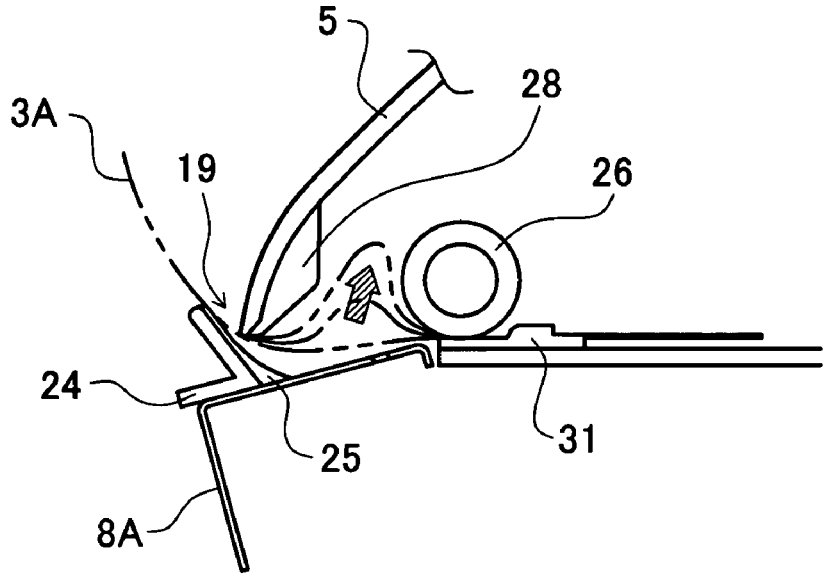
FIGS. 13A and 13B are explanatory views showing effects of the guide rib having an extended portion during feeding of the roll sheet.

Arranged in the label printer 1 in the present embodiment is the cutter unit 8 which is reciprocally moved on the cutter plate 8A to cut the roll sheet 3A in the width direction. The cutter unit 8 cuts the roll sheet 3A when the cutter lever 9 is operated. At this time, a part of the roll sheet 3A upstream of the cutter unit 8 is pressed by the platen roller 26, while another part of the roll sheet 3A downstream of the cutter unit 8 is held against a vertical movement by the discharge port 19 which is narrow in a vertical direction with respect to the printing surface of the roll sheet 3A as shown in FIG. 13A. In the present embodiment, the discharge port 19 is used to restrict the up-and-down (vertical) movement of the roll sheet 3A. In another example, if the discharge port 19 is vertically provided to vertically discharge the roll sheet 3A, the discharge port 19 restricts the right-and-left (horizontal) movement of the roll sheet 3A.

Specifically, the roll sheet 3A to be cut by the cutter unit 8 is supported on both sides of the cutter unit 8; that is, by the platen roller 26 on an upstream side in the feeding direction and by the discharge port 19 on a downstream side. Thus, the roll sheet 3A can be cut finely.

In the label printer 1 in the present embodiment, furthermore, the largest load is applied to the roll sheet 3A at the side edge on the guide member 20 side at the start of cutting. The side edge of the roll sheet 3A tends to wind. At this cutting time, the guide ribs 28 arranged near both side edges of the roll sheet 3A of any width restrict such winding of the side edges of the roll sheet 3A. This makes it possible to effectively bring out the cutting force of the cutting unit 8, thereby finely cutting the roll sheet 3A.

Figure 13B:
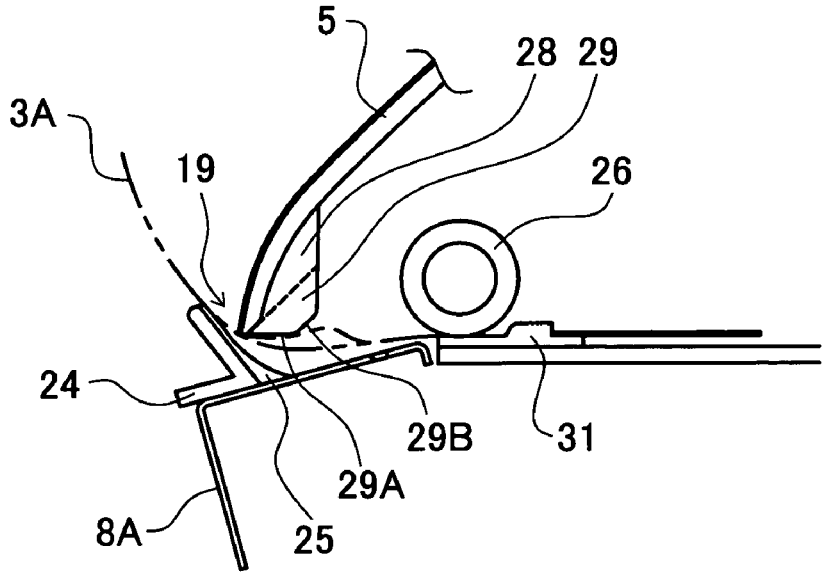

As shown in FIG. 13B, the second guide rib 28 from the holder support member 15 side is formed with a trapezoidal extended portion 29 extending upstream in the feeding direction of the roll sheet 3A and downward in side view. This extended portion 29 restricts an upward movement of the roll sheet 3A with respect to the feeding direction. Because the roll sheet 3A of any width W1 to W4 is mounted in the label printer relative to the holder support member 15, the guide rib 28 having the extended portion 29 is positioned within the feeding path of the roll sheet 3A. The guide rib 28 having the extended portion 29 includes a bottom face 29A substantially parallel to the feeding direction and an upward inclined face 9B continuous to the bottom face 29A on the upstream side in the feeding direction.

The plurality of projecting pieces 25 formed in the guide member 24 forming the lower edge of the discharge port 19 guide the roll sheet 3A toward the discharge port 19. These projecting pieces 25 are arranged at positions not to face to the guide ribs 28, i.e., at positions misaligned with the guide ribs 28, when the top cover 5 is closed and the discharge port 19 is formed. This is to prevent a discharging failure of the roll sheet 3A which may be caused by the discharge port 19 made narrower if the projecting pieces 25 are arranged to face to the guide ribs 28.

Operations of the extended portion 29 of the guide rib 28 will be mentioned in detail below, referring to FIGS. 13A and 13B. FIGS. 13A and 13B are explanatory views of the operations of the extended portion 29; FIG. 13A shows the movement of the roll sheet 3A in the case where the guide ribs 28 have no extended portion and FIG. 13B shows the movement of the roll sheet 3A in the case where the guide rib 28 has the extended portion 29.

To be more specific, FIG. 13A is an explanatory view showing the movement of the roll sheet 3A during feeding in the case where the top cover 5 is provided with only the guide ribs 28 having no extended portion 29. In this case, if a feeding speed of the roll sheet 3A is higher than a discharging speed thereof through the discharge port 19, the force of the platen roller 26 which is exerted on the roll sheet 3A cannot be fully and effectively utilized for feeding the roll sheet 3A. Thus, the feeding force of the platen roller 26 remains. The remaining feeding force will apply an upward force to the roll sheet 3A, which curves (a first curving) as shown by an arrow in FIG. 13A. Even when only a part of the roll sheet 3A curves as above, the part will continuously intricately curves in a space under the top cover 5, resulting in an inability to discharge the roll sheet 3A.

Due to friction generated in the feeding path, the discharging speed of the roll sheet 3A through the discharge port 19 may not be equal to and become slower than the feeding speed of the roll sheet 3A. In general, the frictional influence tends to be larger in a feeding path of a narrow space than in a feeding path of a wide space.

If a printing medium to be fed receives a force in the feeding direction, a difference between a discharging speed and a feeding speed is smaller as the printing medium is made of a material capable of maintaining its posture more firmly. Such printing medium is referred as a medium having high stiffness. A printing medium having low stiffness would curve upward as mentioned above by a force in the feeding direction. In the case where the printing medium is a roll sheet or paper, it is likely to be influenced by moisture, i.e., absorb moisture to swell, and accordingly be deformed into a waved or irregular surface. The printing medium tends to become low in stiffness if absorbs moisture and so susceptible to the friction generated in the feeding path, depending on the deformed degree of the printing medium.

Referring to FIG. 13B, the following explanation is made on operations of the roll sheet 3A during feeding in the label printer 1 in the present embodiment in which at least one of the guide ribs 28 has the extended portion 29.

Similarly to the case shown in FIG. 13A, if a feeding speed of the roll sheet 3A is higher than a discharging speed thereof through the discharge port 19, the force of the platen roller 26 which is exerted on the roll sheet 3A cannot be fully and effectively utilized for the feeding of the roll sheet 3A. As a result, the feeding force of the platen roller 26 remains. The remaining feeding force will apply an upward force to the roll sheet 3A, which curves (a first curving) in the same manner as in FIG. 13A.

However, as shown in FIG. 13B, the extended portion 29 of the guide rib 28 is formed extending to cover the space where the roll sheet 3A curves. Thus, the part of the roll sheet 3A which likely curves will come into contact with the extended portion 29 which prevents the upward curving of the roll sheet 3A. The part of the roll sheet 3A in contact with the inclined face 29B of the extended portion 29 is guided for correct feeding along the feeding path. This prevents the feeding force of the platen roller 26 from escaping through the curving part of the roll sheet 3A. Thus, the feeding force can be utilized fully for feeding the roll sheet 3A, so that the roll sheet 3A can be guided to the discharge port 19 without causing a discharging failure.

In a product such as the label printer 1 in the present embodiment, there may be a case where a printing medium is continuously held in a pressed state by a platen roller during long-term nonuse. A printing medium, namely, a rolled sheet commonly has a downward warp with respect to the feeding path. On the other hand, a rolled sheet pressed by the platen roller for a long term has an upward warp with respect to the feeding path. The guide rib 28 having the extended portion 29 is therefore used to correctly guide the upward warped printing medium to the discharge port 19. In the case where all the guide ribs 28 have the extended portions 29, the feeding path will be made narrower, generating larger friction. This leads to the occurrence of another curving (a second curving), which inhibits the smooth feeding of the printing medium.

The guide rib 28 having the extended portion 29 serves to correctly guide the printing medium having low stiffness to the discharge port 19.

In the label printer 1 in the present embodiment, as mentioned above, seven guide ribs 28 are formed in the edge portion 5A of the top cover 5 for guiding the unwound part of the roll sheet 3A to the discharge port 19. Accordingly, the roll sheet 3A can be discharged smoothly. Furthermore, the second guide rib 28 from the sheet holding member 12 side has the extended portion 29 and the roll sheet 3A of any width W1 to W4 will pass the guide rib 28. This structure makes it possible to prevent a discharging failure caused by the curving (the first curving) of the roll sheet 3A, regardless of its width W1 to W4.

If the ratio of the number of the guide ribs 28 having the extended portions 29 to the total number of guide ribs 28 is high, it may cause the second curving as mentioned above. In the present embodiment, however, only one guide rib 28 has the extended portion 29, which does not cause the second curving.

Such structure that only one guide rib 28 has the extended portion 29 does not cause troubles to design engineers nor increase a manufacturing cost as compared with the case where all the guide ribs 28 have no extended portion 29.

In the guide member 24 provided on the cutter plate 8A, forming the lower edge of the discharge port 19, a plurality of projecting pieces 25 are arranged at positions not to face to the guide ribs 28 and formed to have the upper surface connecting between the upper surface of the cutter plate 8A and the lower edge of the discharge port 19. Accordingly, the projecting pieces 25 do not disturb the discharging of the roll sheet 3A. The roll sheet 3A can smoothly be guided to the discharge port 19 and then discharged to the outside of the label printer 1.

In the label printer 1 in the present embodiment, furthermore, the guide ribs 28 are formed inwardly by 2 mm from each edge of the roll sheets 3A of the widths W1 to W4 in respective width directions. The movement of the roll sheet 3A is restricted by the associated guide rib 28 in addition to the discharge port 19 and the platen roller 26. This makes it possible to effectively apply the cutting force of the cutter unit 8 to the roll sheet 3A. Thus, the roll sheet 3A can be cut finely.

The present invention may be embodied in other specific forms without departing from the spirit or essential characteristics thereof.

For instance, the present embodiment is explained about the label printer 1 using the roll sheet 3A constituted of a thermal sheet wound around the sheet core 3B as a printing medium. Instead thereof, a cut sheet of paper may be used as the printing medium.

Although only one guide rib 28 has the extended portion 29 in the present embodiment, two or more guide ribs 28 may be provided with the extended portions 29 individually. In this case, it is preferable that the ratio of the number of guide ribs 28 having the extended portions 29 to the total number of guide ribs 28 is low, as described above.

The guide ribs 28 in the present embodiment are arranged inwardly by 2 mm from respective edges of the roll sheets 3A in the width direction. The distance may be set in a range of 1 mm to 4 mm or differently from one roll sheet 3A to another.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. A printer comprising:

a printing device which prints print data on a printing medium;

a feeding device which feeds the printing medium to the outside;

a first feeding path member which forms a feeding path which the printing medium fed by the feeding device passes along; and a second feeding path member which is placed to face to the first feeding path member, forming the feeding path;

wherein a plurality of guide pieces for guiding the printing medium to the outside are provided in the first feeding path member at an edge portion thereof and spaced in a direction perpendicular to a feeding direction of the printing medium, at least one of the guide pieces is formed with an extended portion extending further upstream in the feeding direction of the printing medium than the other guide pieces, wherein said extended portion extends near to the feeding path to prevent an upward curving of the printing medium, and the second feeding path member is provided with a plurality of projecting pieces for guiding the printing medium to the outside, the projecting pieces being arranged near an outlet of the feeding path and spaced in the direction perpendicular to the feeding direction.

2. The printer according to claim 1, wherein the printing medium is selected from printing media of different widths such that it is selectively mountable relative to one side edge of each printing medium in a width direction, the side edge being common to the printing media, and the at least one guide piece having the extended portion is placed within the feeding path along which the printing medium of any width is fed.

3. The printer according to claim 2, wherein the guide piece having the extended portion is placed at one position in the feeding path along which the printing medium of any width is fed.

4. The printer according to claim 1, wherein the projecting pieces are placed at positions misaligned with the guide pieces.

5. The printer according to claim 4 further comprising a cutting device which cuts the printing medium in the width direction, wherein the outlet of the feeding path restricts a vertical movement of the printing medium with respect to the feeding direction during cutting of the printing medium.

6. The printer according to claim 5, wherein the guide piece is formed at a position slightly inwardly from a side edge of the printing medium at a cutting start position by the cutting device.

7. The printer according to claim 1 further comprising a cutting device which cuts the printing medium in the width direction, wherein the outlet of the feeding path restricts a vertical movement of the printing medium with respect to the feeding direction during cutting of the printing medium.

8. The printer according to claim 7, wherein the guide piece is formed at a position slightly inwardly from a side edge of the printing medium at a cutting start position by the cutting device.

9. The printer according to claim 3 further comprising a cutting device which cuts the printing medium in the width direction, wherein the outlet of the feeding path restricts a vertical movement of the printing medium with respect to the feeding direction during cutting of the printing medium.

10. The printer according to claim 9, wherein the guide piece is formed at a position slightly inwardly from a side edge of the printing medium at a cutting start position by the cutting device.

11. A printer comprising:

a printing device which prints print data on a printing medium;

a feeding device which feeds the printing medium to the outside;

a first feeding path member which forms a feeding path which the printing medium fed by the feeding device passes along; and a second feeding path member which is placed to face to the first feeding path member, forming the feeding path;

wherein a plurality of guide pieces for guiding the printing medium to the outside are provided in the first feeding path member at an edge portion thereof and spaced in a direction perpendicular to a feeding direction of the printing medium, at least one of the guide pieces is formed with an extended portion extending further upstream in the feeding direction of the printing medium than the other guide pieces, so that the extended portion extends near to the feeding path to prevent an upward curving of the printing medium, and the second feeding path member is provided with a plurality of projecting pieces for guiding the printing medium to the outside, the projecting pieces being arranged near an outlet of the feeding path and spaced in the direction perpendicular to the feeding direction.

12. The printer according to claim 11 further comprising a cutting device which cuts the printing medium in the width direction, wherein the outlet of the feeding path restricts a vertical movement of the printing medium with respect to the feeding direction during cutting of the printing medium.

13. The printer according to claim 12, wherein the guide piece is formed at a position slightly inwardly from a side edge of the printing medium at a cutting start position by the cutting device.

14. A printer comprising:

a printing device which prints print data on a selected one of printing media of different widths;

a feeding device which feeds the printing medium to the outside, the selected printing medium being mounted relative to one side in a width direction, common to the printing media of any width;

a cutting device which cuts the printing medium in the width direction;

a first feeding path member which forms a feeding path which the printing medium fed by the feeding device passes along; and a second feeding path member which is placed to face to the first feeding path member, forming the feeding path;

wherein a plurality of guide pieces for guiding the printing medium to the outside are provided in the first feeding path member at an edge portion thereof and spaced in a direction perpendicular to a feeding direction of the printing medium, each guide piece being slightly spaced from a side edge of the printing medium at a cutting start position by the cutting device, the guide piece formed at one place in the feeding path along which the printing medium of any width is fed is provided with an extended portion extending upstream in the feeding direction of the printing medium, the second feeding path member is provided with a plurality of projecting pieces for guiding the printing medium to the outside, the projecting pieces being arranged near an outlet of the feeding path and spaced in the direction perpendicular to the feeding direction, at positions misaligned with the guide pieces, and the outlet of the feeding path restricts a vertical movement of the printing medium with respect to the feeding direction during cutting of the printing medium.

* * * * *